United States Patent [19]

de Jong

[11] 3,936,533

[45] Feb. 3, 1976

[54] METHOD FOR APPLYING CONTRAST COLOURED MARKING LINES TO THE SURFACE OF ROADS

[75] Inventor: Jan de Jong, Roermond, Netherlands

[73] Assignee: Fabran Holding B.V., The Hague, Netherlands

[22] Filed: June 15, 1973

[21] Appl. No.: 370,553

[30] Foreign Application Priority Data

June 16, 1973 Netherlands ..... 7208316

[52] U.S. Cl. ..... 427/137; 401/2; 401/5; 427/286

[51] Int. Cl.[2] ..... B44D 3/22

[58] Field of Search ..... 117/37 R, 43, 111 H; 118/413, 415; 401/2, 5, 48, 193

[56] References Cited

UNITED STATES PATENTS

| | | | |
|---|---|---|---|
| 2,870,695 | 1/1959 | Kellogg | 401/48 |
| 3,145,410 | 8/1964 | Stahl | 118/413 X |
| 3,289,241 | 12/1966 | Garrison et al. | 118/415 X |
| 3,319,600 | 5/1967 | Regan | 401/5 |
| 3,585,129 | 6/1971 | Delfel | 117/43 X |

*Primary Examiner*—Thomas J. Herbert, Jr.
*Assistant Examiner*—Bruce H. Hess
*Attorney, Agent, or Firm*—Cushman, Darby & Cushman

[57] ABSTRACT

A method is disclosed for applying rather viscous line marking material to road surfaces whereby simultaneously with the manufacturing of marking strips in the same continuous motion crossribs from the same material are shaped on the marking strips. The marking material flows out through a slit between the back edge of the bottom side and the lower edge of the back wall of a storage box, a periodical up- and down movement being imparted to this back wall for shaping the ribs, preferably by means of fast upward driving impulses each of one followed up by a separate downward driving impulse. Preferably the material is forced to flow out substantially in a direction at an angle of at least 30° to the direction of movement of the storage box and the trailing end thereof is kept in engagement with the road surface.

9 Claims, 4 Drawing Figures

METHOD FOR APPLYING CONTRAST COLOURED MARKING LINES TO THE SURFACE OF ROADS

BACKGROUND OF INVENTION

1. Field of the invention

This invention relates generally to the application of marking lines of contrast coloured material such as strips of synthetic resin paint to road surfaces for the guidance of traffic.

2. Description of the prior art

It is well-known in the art to apply such strip-shaped lines by means of spray painting, the paint being supplied to a spray nozzle on a carriage moved along the road surface, the thickness of the paint strip being adjustable by means of a jet needle by which the nozzle can also be closed. According to another known method a narrow strip of tar was laid on the road surface by a tar sprayer which was followed by a grit spreader discharging white grit from a controlled slit-shaped opening, carried above and parallel to the road surface. By these known methods only strips of regular continuous thickness could be made, though this thickness could be adjusted to a value as desired.

It is also known per se in the prior art to enclose the traffic lanes on the road surface between prefabricated marking strips of concrete provided with parallel cross ribs following a zigzag course in their longitudinal direction, rather steep light-reflecting front faces of the ribs being directed at least by their upper portions against the headlights of approaching vehicles. In this known art the marking strip appeared, thanks to the close succession of these ribs to the oncoming traffic as a clearly visible, continuous, farstretching, shining strip even in dark and bad weather. Until now, however, it was very expensive to provide roads with such ideal marking lines and the application was restricted therefore to extremely dangerous road bends.

In the field of road construction a method has been proposed for the continuous construction of ribbed retaining beams along the sides of road pavements from concrete which is poured between the side walls of a bottomless mould which is moved along the side of the road surface and the ribs are formed on the surface of the beam by means of an outward and inward swinging movement of a hinged mould back wall, controlled by eccentrics or cranks on a rotating axle.

In still another field of the art, to be the art of providing a prefabricated band with a ribbed or knurled surface of a snowy or lump-forming material it has been proposed to use the band as the bottom of a bottomless storage box comprising the said material, this band being moved relatively along the bottomside of the boxframe e.g. by unwinding it from a reel; an oscillatory up- and down movement being imparted to the back wall of the box so that the lower edge of the said wall will shape a ribbed or knurled surface of the material left behind upon the prefabricated band, a knurled shape being obtained by providing the said wall with a toothed lower edge.

SUMMARY OF THE INVENTION

It is an object of the present invention to operate a storage box or trough provided with a discharge slit for the supply of marking material on the road surface and to control the height of the slit during its movement above and parallel to a road surface in such a way that not only a marking strip is formed on the road surface, but at the same time parallel cross ribs are formed in close succession on the surface of this strip from the same material.

It is a further object of the invention to present a method by which these ribs, though manufactured on the road surface in one track by the use of a small storage carriage which is continuously moved in one direction, have an ideal shape for obtaining clear visibility of the marking line as indicated hereinbefore.

This object cannot be obtained even if gauges as known from the above-mentioned prior art would be used for the present purpose, because an oscillatory up- and down or out- and inward swinging movement of the back wall of a storage box as used in the prior art would cause a sinusoidal curving of the upper surface of a marking strip but would not shape ribs as desired for the present purpose.

According to the present invention the storage trough or box is filled with rather viscous marking material (e.g. plastic paint with "filler" substances). The said box is moved into the longitudinal direction of the road surface, a discharge slit at the trailing end of the storage box being bordered at its lower side by the back bottom edge or the imaginary line connecting the lower trailing ends of the box sidewalls and its upper side by the corresponding lower edge of a box back wall or back wall portion, which is executed as a slide for up- and down movement in vertical guides at the end of the box. An adjustable stop limits the lowest position of the said slide in operation for defining the thickness of the marking strip and another adjustable stop limits its maximum upper position for defining the height of the ribs to be shaped. At least the trailing bottom end side of the storage box and eventually the whole bottom of the box are moved in close proximity and preferably in engagement with the road surface that is in a shoving movement along the road. In order to obtain a fully satisfactory result as to the shaping of sufficient steep rib front surfaces directed against oncoming traffic at least for the upper rib parts (near their crests) it is essential that the upward movement be imparted to the sliding back wall by a fast impulse, e.g. to be initiated by a blow so that the upper position be reached within a space of time shorter than one half of the periodicity of succession of the said impulses, a separate, independent impulse being applied each time after breaking off the upward impulse for moving the slide down onto its lower working position, wherein the height of the discharge slit corresponds to the basic thickness of the marking strip.

Thus, this invention provides a method for applying contrast-coloured marking lines to the surface of roads by passing a storage trough comprising the marking material along the road surface and discharging the material from a controlled, slit-shaped opening, carried above and parallel to the road surface, characterized in that in a continuous motion of shaping a marking strip of viscous material on the road surface parallel cross ribs are formed simultaneously in close succession on the said marking strip from the same material by imparting a periodical up and down movement to at least a portion of the trough backwall defining by its lower edge and upper boundary of the said material discharge slit the lower boundary of the said discharge slit being defined by the corresponding outer edge of the trough bottom at its trailing end.

This invention is further characterized in that an upward impulse is periodically imparted to the said backwall part so as to initiate a fast movement from its lower rest position onto its highest position within a space of time shorter than one-half of the periodicity of succession of the said impulses, a separate independent impulse being applied each time after breaking off the said upward impulse for moving the said wall down onto its lower working position, wherein the height of the discharge slit corresponds to the basic thickness of the said marking strip.

For the same purpose it is further advantageous that the velocity of the outstreaming material be lowered by arranging at least substantially parts of the discharge slit at an angle of at least 30° to the direction of the forward movement of the storage box.

The above and other features of the invention, including various novel details will now more particularly be described with reference to the accompanying drawing.

BRIEF DESCRIPTION OF THE DRAWING

The drawing illustrates in a schematic way an apparatus arranged for the application of the new method to be described at the hand of this drawing.

Figure 1:
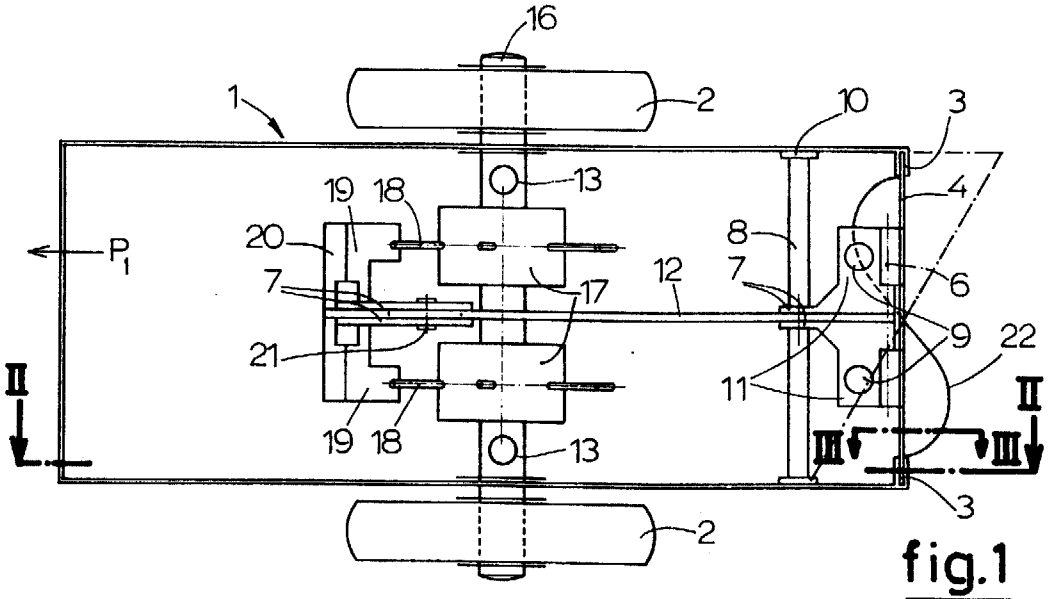
FIG. 1 is a top view on a storage box mounted on a pair of road wheels.
Figure 4:
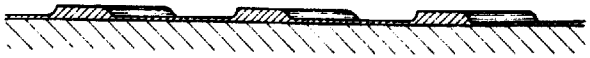
FIG. 4 is a longitudinal section through a part of a marking strip as applied to and at the same time manufactured upon the road surface by the new method.

The box 1 is moved on its wheels 2 in the longitudinal direction P1 of the road upon which the marking strip is to be manufactured. On both sides of the back end or trailing end of the box in operation guides 3 are provided for the box back wall 4 which is mounted slidably between those guides 3 in sealing engagement in order to prevent leaking out of the marking material with which the box 1 is to be filled. In the position as shown the lower edge of the sliding wall 4 provides also for a sealed closure against the corresponding outer edge of the box bottom 5.

In operation, the lower position of the slide 4 will be defined by an adjustable stop member (as known in the art and not shown in the drawing) defining the minimum height of the discharge slit between the lower edge of the slide 4 and the corresponding edge of the box bottom 5 and thereby the basic thickness of the marking strip to be shaped upon the road surface. The up- and-down movement of the slide 4 is controlled as a practical example e.g. for a marking strip having a basic thickness of 1,5 mm so as to shape parallel cross ribs thereon having a height of 6 to 10 mm at a distance of 40 to 80 mm from each other. This movement is imparted by impulses of a character as mentioned hereinbefore in order to insure that the vertical boundary surface of the viscous marking material mass inside the box 1 against the inner surface of the slide 4 in its lower position is suddenly made free by a fast upward movement of the slide to move outward from the box upon the material of the basic marking strip which flows continuously outward through the lower part of the discharge slit. Thus the front slope of the ribs will maintain a steepness as desired.

In the example as shown one end of a lever 7 is hinged at 6 to the slide 4. The lever 7 swings around an axle 8 which is supported in the longitudinal side walls of the box 4 and it is pushed to a position corresponding to the lower position of the slide 4 by means of springs 9 compressed between a strip 10 (FIG. 2) on the box side walls and side wings 11 of the lever 7. These side wings 11 provide at the same time for the hinge connection with the slide 4. The longer lever arm 12 extends above and past an axle 16 bearing the road wheels 2. The axle 16 is vertically guided through slits in the box side walls which are sealed against leaking out of marking material by means of discs bearing against the inner surfaces of these side walls. Springs 15 are compressed between the axle 16 and a cross strip 14 bearing upon the box side walls. In this way part of the weight of the storage box 1, which keeps its bottom 5 in engagement with the road surface is carried by the carriage comprising the axle 16 and wheels 2. As is self-evident from the drawings, cylindrical casings 13 are retainers for springs 15 and 9.

The axle 16 bears fixed thereto inside the box 4 a pair of hubs 17 and from each of these extends a row of radially directed pins 18. These pins rotate in the sense of arrow P2 when the carriage is moved in the direction P1 and successively they impart blows to the hook ends 19 of a wing piece 20 fixed to the lever arm 12 by means of a slit and screw bolt connection 21 allowing longitudinal adjustment of the wing piece 20 along the arm 12 and thereby adjustment of the time period of engagement of the blowing ends of the pins 18 with the wing piece parts 19. The ends of the pins 18 impinge upon the leverarm 12 with their own velocity of rotation and it will be clear that the lever end is pulled down with corresponding velocity so that the slide 4 is pulled upwardly pulselike with great velocity against the action of the springs 9 loading them up. Each time when a pair of pins 18 leaves the hook ends 19 the drive of the slide 4 is further left to the springs 9. The maximal upper position of the slide 4 and therewith the maximum height of the discharge slit of the storage-box, that is the height of the ribs on the marking strip may further be defined by an adjustable stop for the upward movement of the slide (not shown).

It will also be clear that the time period during which each pair of pins 18 is in engagement with lever part 19 can be made shorter than one half of the time period between two successive blows. After breaking off of each upward impulse the springs 9 take care of an independent downward impulse to the slide 4, by which the latter takes its lower working position before the next upward blow follows. During the lapse of time in between, a small length of marking strip is shaped each time at its basic thickness between two successive ribs. The transition of the drive to the springs 9 before they initiate the downward movement of the slide 4 includes a short floating time before the downward movement sets in and during that time a less or more flattened crest is shaped on the top of the ribs because the box carriage moves onward in the meantime. A steep back side of the ribs is thereupon shaped by the accelerated downward movement of the slide 4.

According to the example shown in the drawing each hub 17 bears 6 pins 18 equally divided around its circumference and when the wheels 2 would have a circumference of e.g. 36 cm six ribs will be shaped at equal distances from each other on a marking strip length of 36 cm. Other proportions may be obtained by changing out the wheels for other ones with another diameter, by changing the number of pins or by inserting a variator gear box between the axle 16 and the hubs 17. The marking substance within the box 1 may be separated from driving parts by arranging an inner housing enclosing the hubs and end parts of lever arm 12, the portion of this arm leaving this inner housing being led through a slit therein provided with a sealing.

Figure 2:
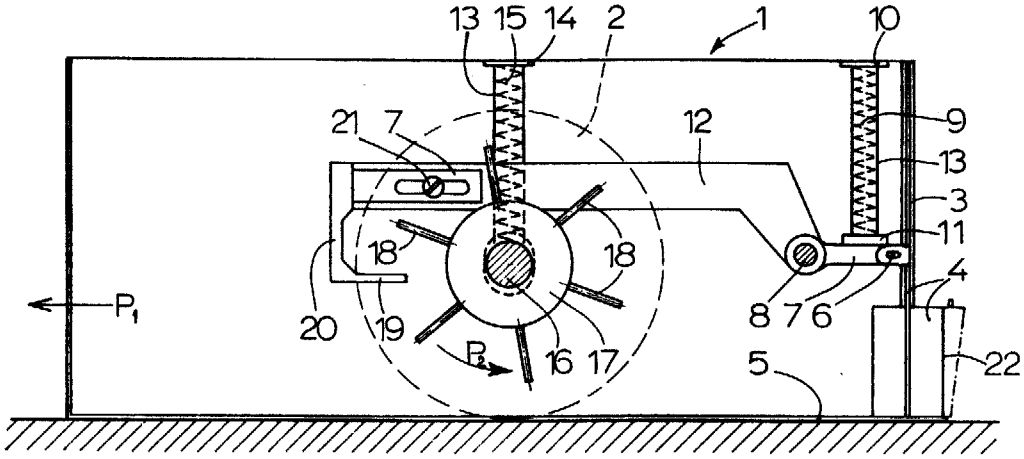
FIG. 2 is a side view of the same carriage, its side wall at the side of the viewer being removed.

It is of advantage to use a greater length of the slit for a given width of the marking strip and at the same time to change the direction of outflow of the marking material, making it possible to use less viscous material as the outflow is made slower because a given volume per time unit will flow out through a longer slit and because the change in direction will increase inner friction between the mass particles. For this purpose the position of the slide and the length of side and bottom walls may be chosen so as to obtain an oblique position of the slide 4 and thereby for the discharge slit with respect to the direction of movement of the storage carriage 1 as indicated by a chain line in FIG. 1. The same result may be obtained, however, by using a corrugated plate at least for the lower part 22 of the slide 4 and cutting of the trailing edge of the bottom 5 along a corresponding line as shown in FIGS. 1 and 2. Of course the top of the waves extending each at one side of the plane 4 should be covered in order to prevent streaming out of marking material through these top ends of the corrugated slide part 22. Also the ribs shaped upon the marking strip will then run along a corrugated line in their longitudinal direction and when desired the overall direction of each rib may include an angle with the direction P1 if at the same time the measure as indicated hereabove by the chain line of FIG. 1 is taken. These measures bring not only wellknown advantages as to the reflection of the light from traffic vehicles, but in the execution of the present method they allow an outflow of material with lower velocities (as above explained) in order to maintain steep rib slopes even with low viscosities of the marking material. Also by the fact that at least substantial portions of the slide 4 above the discharge slit are receding sideways the carrying away of material from the ribs by the lower edge of the slide 4 on its forward movement is restricted and at the same time the sliding of the substantially obliquely positioned slide wall portions cause a smoothing of the rib surfaces at the rib front sides.

Where the expression "corrugated" is used the spirit of the considered measure includes a "meandering" line comprising straight portions interconnected at rounded meeting corners.

Figure 3:
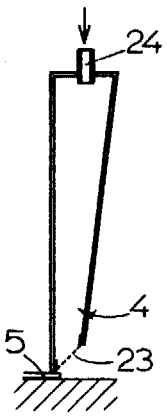
FIG. 3 is a sectional detail on a larger scale.

FIG. 3 illustrates (vide in FIG. 1 the part built on to the outer side of the lower slide portion 22 as indicated by a chain line) that the slide 4 may be partly executed as a flat box into which a medium, e.g. heated air, may be supplied through a connector pipe 24. This medium streams out through a gauze covered opening 23 at the lower edge of the slide 4 upon the surface of the material flowing out through the discharge slit of the storage box 1.

By these means the hardening of thermosetting plastics can be accelerated by means of heated air or the outflow of viscous thermoplastic material may be improved, and eventually the formation of lumps at the lower edge of the slide 4 may be prevented thereby. Depending on the marking material to be used it is also made possible by these means to supply a cooling medium on the surface of the marking strip or to supply hardening means to the said surface.

What I claim to be new and desire to protect by letters Patent is:

1. A method for continuously forming and applying contrast colored marking lines including raised periodic projecting crossrib structures on the surface of a road, said method including the steps of:

providing a storage trough containing a contrast colored viscous marking material, passing said storage trough over said road surface along a path over which it is desired to apply said marking line, providing a controllable slit-shaped opening along the lower trailing edge of said storage trough with the opening dimensions being controlled by an upwardly and downwardly movable back wall member, said slit-shaped opening being carried above and substantially parallel to the said road surface and discharging said marking material therefrom, repetively moving said back wall member upwardly with a fast impulse motion such that an upper limit position is attained within a time shorter than one-half of the time period between such upwardly directed impulse movements, and repetively moving said back wall member downwardly to a lower limit position after each of said upwardly directed movements thereby continuously forming and applying marking lines having a basic thickness corresponding to said lower limit position, a raised crossrib projection thickness corresponding to said upper limit position, and a relatively steeply inclined reflecting face on each such crossrib corresponding to the upwardly directed fast impulse motion of said back wall member.

2. A method as in claim 1 wherein said downwardly directed movements are also caused to comprise fast impulse motions such that the lower limit position is attained within a time shorter than one-half the time period between such downwardly directed impulse movements whereby both the leading and trailing faces of the inclined crossribs are relatively steeply inclinded corresponding to the fast upward and fast downward impulse motions respectively.

3. A method as in claim 1 wherein a lower edge of said opening is moved in substantial engagement with the road surface therebeneath.

4. A method as in claim 3 further comprising the step of carrying at least part of the weight of said trough on road wheels through the intermediary of springs disposed between the trough structure and an axle structure carrying said road wheels.

5. A method as in claim 1 wherein:

said upwardly directed impulse movements are imparted by physically striking one end of a lever whose other end is mechanically coupled to said back wall member, said physical striking being provided by the ends of pins radially extending from an axle which is driven by wheels in contact with said road surface, and said downwardly directed movements being imparted by springs acting upon said lever, said springs storing energy from said physical striking and thereafter releasing said stored energy when said lever is released by continued subsequent movement of said pins.

6. A method as in claim 1 further comprising the step of directing said slit-shaped opening at an angle of at least 30° with respect to the longitudinal direction of the marking strip.

7. A method as in claim 6 wherein the shape of back wall member along a direction transverse to said marking line includes a plurality of portions directed in other than a straight transverse line so as to define a non-linearly slit-shaped opening.

8. A method as in claim 1 further comprising the step of heating the outer surface of said marking material after it has been discharged onto said road surface.

9. A method as in claim 8 wherein said heating step comprises feeding a heated medium over the outer surface of said back wall member and then upon the upper surface of said marking strip.

* * * * *